US009830863B1

(12) United States Patent
Carrico

(10) Patent No.: US 9,830,863 B1
(45) Date of Patent: Nov. 28, 2017

(54) CONTENT-BASED SELECTABLE AREA BRIGHTNESS CONTROL FOR DISPLAYS

(71) Applicant: Matthew J. Carrico, Mount Vernon, IA (US)

(72) Inventor: Matthew J. Carrico, Mount Vernon, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 14/617,565

(22) Filed: Feb. 9, 2015

(51) Int. Cl.
*G09G 5/00* (2006.01)
*G09G 3/34* (2006.01)

(52) U.S. Cl.
CPC ... *G09G 3/3406* (2013.01); *G09G 2320/0233* (2013.01); *G09G 2320/0626* (2013.01); *G09G 2320/0686* (2013.01)

(58) Field of Classification Search
CPC ..... G09G 2320/0686
See application file for complete search history.

(56) References Cited

U.S. PATENT DOCUMENTS 7,724,155 B1 5/2010 Anderson et al.
2004/0164948 A1* 8/2004 Kabel ..... G09G 3/3406 345/102
2004/0252076 A1* 12/2004 Kodama ..... G09G 3/3208 345/3.1
2006/0227125 A1* 10/2006 Wong ..... G09G 5/14 345/211
2007/0060355 A1* 3/2007 Amaitis ..... G06Q 20/3224 463/40

* cited by examiner

*Primary Examiner* — Jennifer Mehmood
*Assistant Examiner* — Carl Adams
(74) *Attorney, Agent, or Firm* — Angel N. Gerdzhikov; Donna P. Suchy; Daniel M. Barbieri

(57) ABSTRACT

Systems and methods for providing content-based localized brightness control are disclosed. A system may include a display panel configured to support independently controllable brightness levels for a plurality of pixel groups within the display panel. The system may also include a processor in communication with the display panel. The processor may be configured to identify a specific pixel group of the display panel based on content being displayed in the specific pixel group, and the processor may be further configured to set a brightness level of the specific pixel group differently from another pixel group of the display panel.

20 Claims, 6 Drawing Sheets

CONTENT-BASED SELECTABLE AREA BRIGHTNESS CONTROL FOR DISPLAYS

BACKGROUND

A display device is typically illuminated using a light source. For example, a Liquid-Crystal Display (LCD) may use an array of Light Emitting Diodes (LEDs) as the light source. Light sources for such displays are arranged in a manner to provide uniform lighting across the viewable display area, typically using reflectors and diffusers for even distribution of the light.

SUMMARY

Embodiments of the inventive concepts disclosed herein are directed to a system. The system may include a display panel configured to support independently controllable brightness levels for a plurality of pixel groups within the display panel. The system may also include a processor in communication with the display panel. The processor may be configured to identify a specific pixel group of the display panel based on content being displayed in the specific pixel group, and the processor may be further configured to set a brightness level of the specific pixel group differently from another pixel group of the display panel.

In one aspect, the inventive concepts disclosed herein are directed to a system. The system may include a display panel configured to support independently controllable brightness levels for a plurality of pixel groups within the display panel. The system may also include an ambient light sensor and a processor in communication with the display panel and the ambient light sensor. The processor may be configured to adjust an overall brightness level of the display panel at least partially based on input received from the ambient light sensor. The processor may also be configured to adjust a local brightness level of a specific pixel group of the display panel, wherein the local brightness level of the specific pixel group is different from another pixel group of the display panel.

A further embodiment of the present disclosure is directed to a method. The method may include: identifying a specific pixel group of a display panel, the specific pixel group being identified based on content being displayed in the specific pixel group; and displaying the specific pixel group at a brightness level different from another pixel group of the display panel.

It is to be understood that both the foregoing general description and the following detailed description are exemplary and explanatory only and are not restrictive of the inventive concepts disclosed and claimed herein. The accompanying drawings, which are incorporated in and constitute a part of the specification, illustrate embodiments of the inventive concepts and together with the general description, serve to explain the principles and features of the inventive concepts disclosed herein.

BRIEF DESCRIPTION OF THE DRAWINGS

The numerous objects and advantages of the inventive concepts disclosed herein may be better understood by those skilled in the art by reference to the accompanying figures in which.

DETAILED DESCRIPTION

Reference will now be made in detail to exemplary embodiments of the inventive concepts disclosed herein, examples of which are illustrated in the accompanying drawings.

Avionic systems (may also be referred to as avionics) may utilize one or more displays for presentation of information. One of the requirements for an avionics display is to be able to control the brightness of the display as a function of ambient light conditions and/or user preferences. For instance, the brightness of the display may be decreased at night to preserve night vision capabilities of a pilot (may be generally referred to as a user). On the other hand, the brightness of the display may be increased during the day so that the display is more readable.

For a Liquid-Crystal Display (LCD), the primary method of controlling the brightness of the display is controlling the brightness of the light source (e.g., backlight) utilized to illuminate the display. Typically, the light source is controlled by a single brightness setting, allowing the entire viewable area of the display to be set to the same brightness level. It is noted, however, that a shortcoming of this brightness control technique is that the entire display is dimmed or brightened as a whole, making it difficult to support display formats that have varying regions of light and dark areas (such as maps and charts) that may benefit from localized brightness control for enhanced readability.

Organic Light-Emitting Diode (OLED) display technology uses emissive organic material to directly generate light and hence does not require a backlight. This means, in effect, that each pixel on an OLED display may be an independently addressable element for both color and brightness. The brightness of individual pixels, or groups of pixels, may be independently controlled to provide desired brightness levels, enabling localized brightness control without the aforementioned shortcomings of LCDs.

Embodiments of the inventive concepts disclosed herein provide various techniques for localized brightness control that are at least partially based on the content being displayed. In some embodiments, ambient light sensor(s) and user preference(s) may still be utilized to control the overall brightness level; moreover, context information obtained based on the content that is being displayed may be utilized to determine additional brightness level control for specific areas of the display.

The localized brightness control techniques disclosed herein may be collectively referred to as content-based selectable area brightness control techniques. It is contemplated that while the various content-based selectable area brightness control techniques disclosed herein may be implemented on OLED displays, other display technologies that support separately addressable display elements may also utilize the brightness control techniques without departing from the broad scope of the inventive concepts disclosed herein.

Figure 1:
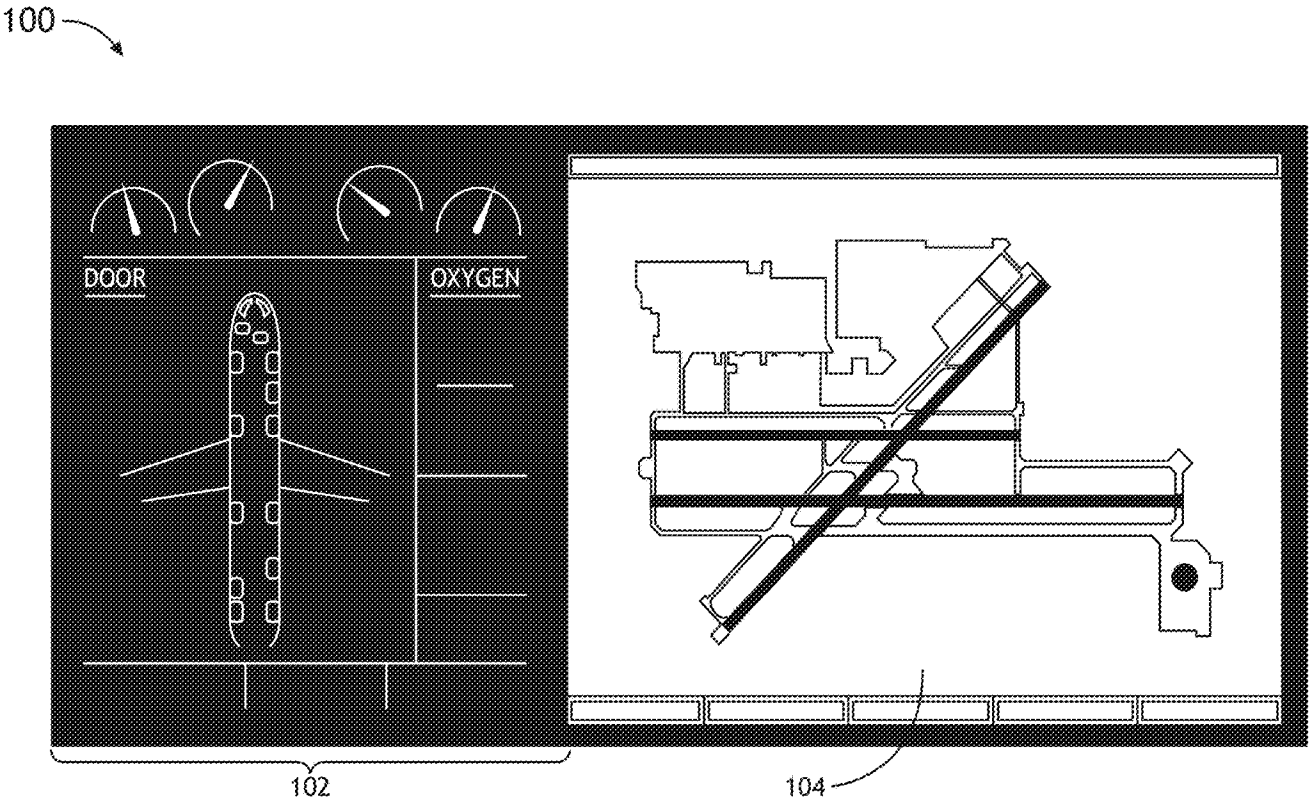
FIG. 1 is an illustration depicting an exemplary view including regions of light and dark areas.

Referring to FIG. 1, an illustration depicting an exemplary view 100 is shown. The exemplary view 100 may include regions of light and dark areas that may benefit from localized brightness control for enhanced readability. More specifically, the exemplary view 100 may include an aircraft condition report window 102 and an airport map window 104. A user may choose to view the aircraft condition report window 102 and the airport map window 104 together as a part of a pre-departure routine. However, it is noted that the aircraft condition report window 102 may be presented on a dark background while the airport map window 104 may be presented on a bright background. As a result, for a display device that is only capable of providing uniform illumination across the entire exemplary view 100, the darkness of the aircraft condition report window 102 and the brightness of the airport map window 104 may contrast sharply, making it difficult for the user to read the exemplary view 100.

In some embodiments in accordance with the inventive concepts disclosed herein, brightness levels of the various windows (e.g., windows 102 and 104) may be controlled and/or adjusted separately. For instance, the user may selectively decrease the brightness level of the airport map window 104 (or selectively increase the brightness level of the aircraft condition report window 102) while keeping the brightness level of the rest of the exemplary view 100 unchanged. It is contemplated that the user may control the brightness levels of the various windows (e.g., windows 102 and 104) via a control interface that may include a touch screen interface, a keyboard interface, a turn knob interface, as well as various other types of input devices without departing from the broad scope of the inventive concepts disclosed herein.

It is contemplated that the brightness levels of the various windows (e.g., windows 102 and 104) set by the user may be maintained automatically. For example, suppose that the user have set the brightness level of the airport map window 104 to be a certain percentage (or units) lower than the rest of the exemplary view 100, and further suppose that the ambient light condition has changed and the brightness of the entire exemplary view 100 should be increased. In such situations, the brightness level settings of the various windows set by the user may be maintained automatically, and as a result, the brightness level of the airport map window 104 may be kept at the same percentage (or units) lower than the rest of the exemplary view 100 after the overall brightness increase.

Alternatively, the brightness levels of the various windows may be set to be absolute. In this manner, a window (e.g., the airport map window 104) with an absolute brightness level setting may maintain the same brightness level regardless of ambient light conditions, while the brightness of the rest of the exemplary view 100 may change based on ambient light conditions.

It is also contemplated that the brightness levels of the various windows (e.g., windows 102 and 104) may be configured systematically. For instance, each window 102 or 104 may be managed by an application (e.g., a software, firmware or hardware package) that presents information to the user via one or more windows it manages. An application may be made aware of a brightness profile of a window which the application manages. A brightness profile may indicate a scale of brightness (e.g., scaled 1 through 10 from dark to bright). In this manner, a window (e.g., the airport map window 104) with a high scale of brightness may be automatically displayed at a lowered brightness level compared to a window (e.g., the aircraft condition report window 102) with a low scale of brightness. The user may accept this automatic configuration, or make further adjustments to the brightness levels of the various windows as previously described.

It is to be understood that only two windows 102 and 104 are depicted in the examples above for purposes of presentation simplicity. More than two windows may be displayed and their respective brightness levels may be controlled in the same manners as described above. It is also to be understood that the term "window" generally refers to an area within the exemplary view 100. It is contemplated that an area may be defined by an application (e.g., a map application may define and manage the airport map window 104 for presentation of the airport map) or by a user (e.g., the user may manually select or define an area within the exemplary view 100). It is contemplated that the selective brightness control techniques as described above is applicable to both application-defined windows and/or user-defined windows without departing from the broad scope of the inventive concepts disclosed herein.

It is also contemplated that the selective brightness control techniques in accordance with the inventive concepts disclosed herein are not limited to controlling brightness levels of various windows; similar brightness control techniques are also applicable to text messages, dialog boxes, symbols, as well as other types of graphical user interface elements and/or indicators presentable on a display device.

Figure 2:
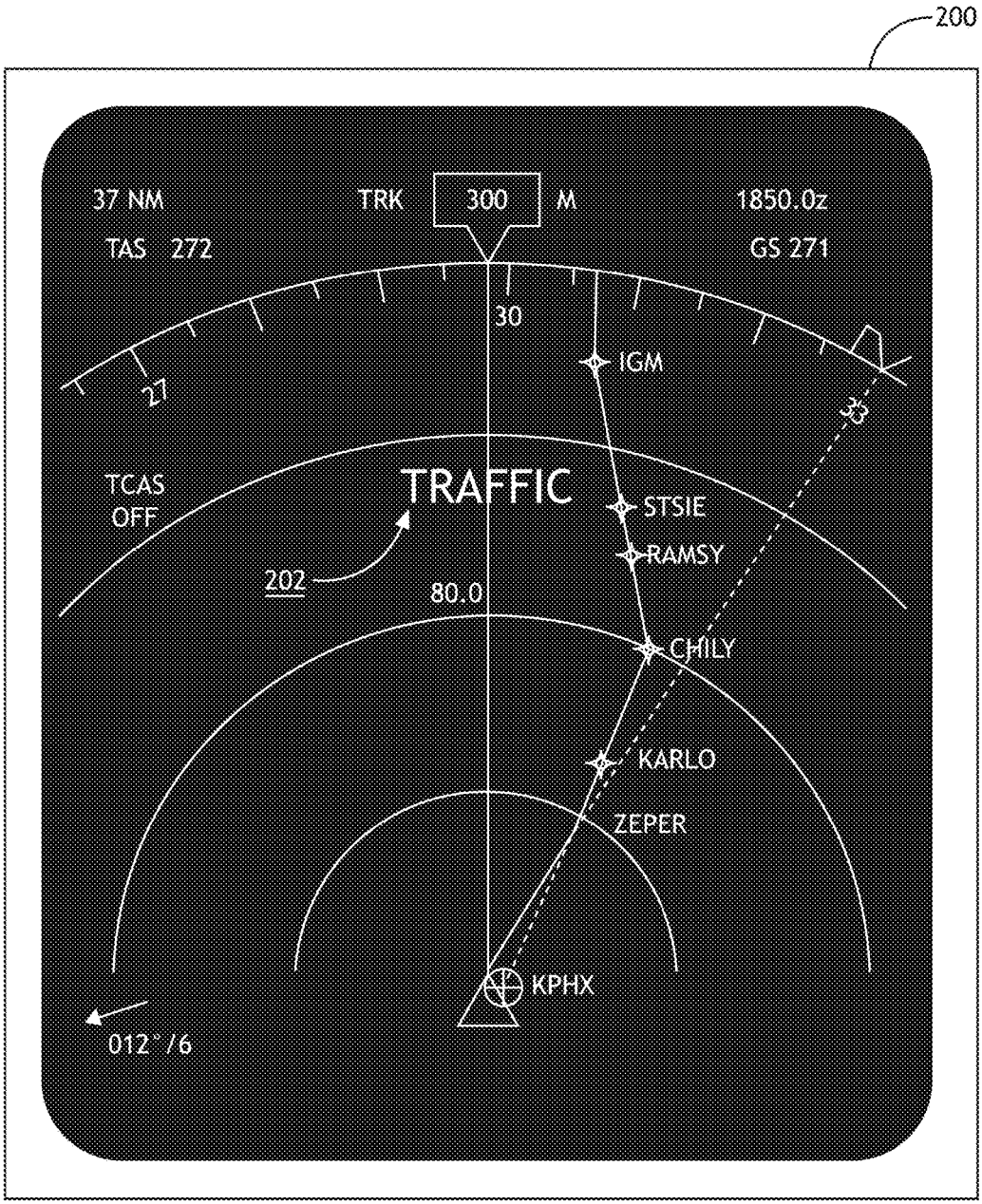
FIG. 2 is an illustration depicting an exemplary view including an alert message.

Referring to FIG. 2, an illustration depicting an alert message 202 displayed on a display device 200 is shown. Typically, the alert message 202 may be displayed or highlighted using different colors to indicate different levels of urgency. In some embodiments in accordance with the inventive concepts disclosed herein, the brightness level of the alert message 202 may be controlled and/or adjusted in addition to (or alternative to) conventional color-based indications. For example, the display device 200 may be configured to display the alert message 202 at a certain brightness level that is higher than the rest of the display device 200. In another example, the display device 200 may be configured to use different brightness levels for the alert message 202 to indicate different levels of urgency. In still another example, the display device 200 may be configured to continuously alternate the brightness level of the alert message 202 so that the alert message 202 may appear to be flashing. It is contemplated that the brightness level of the alert message 202 may be controlled and/or adjusted in various other manners without departing from the broad scope of the inventive concepts disclosed herein.

Figure 3:
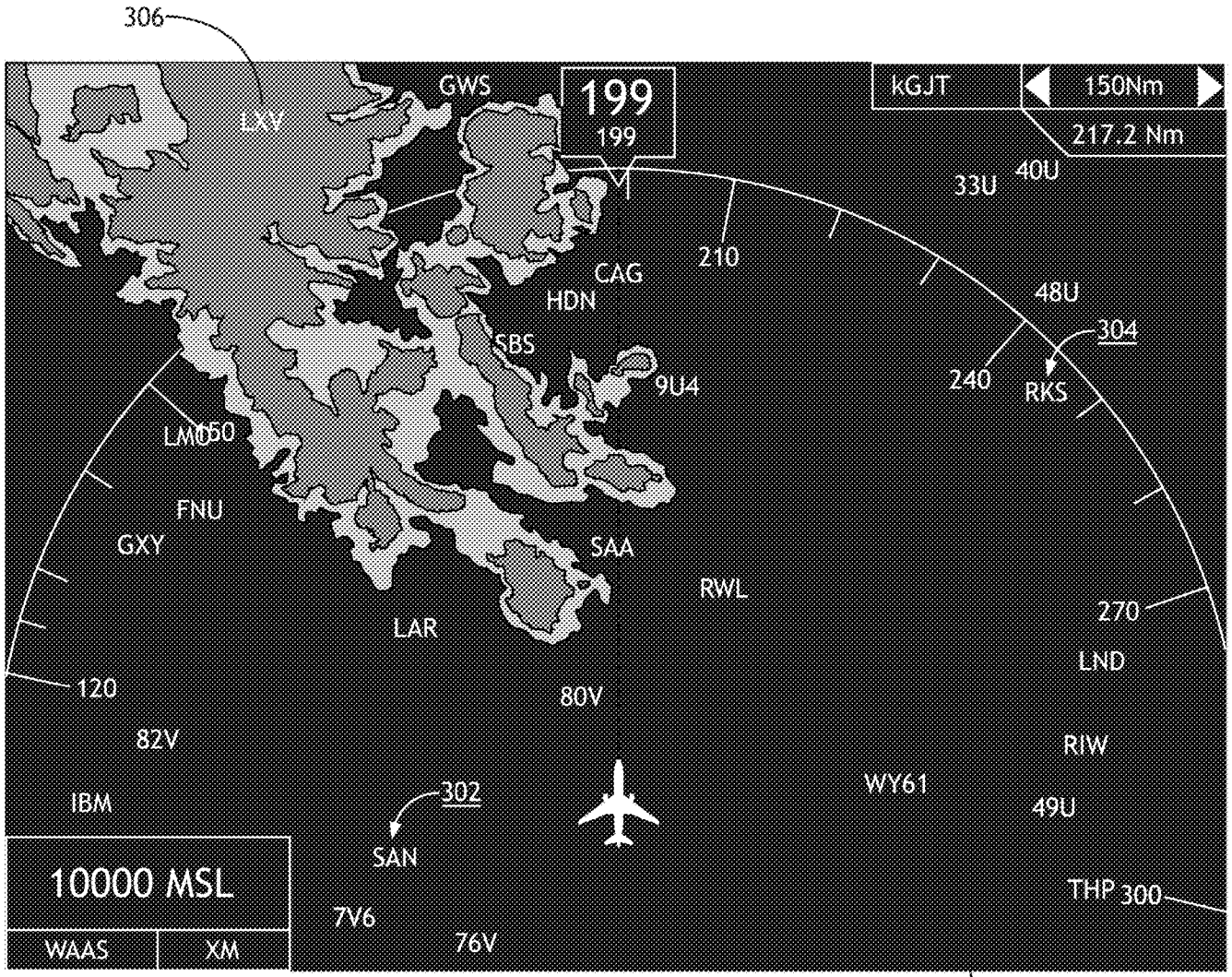
FIG. 3 is an illustration depicting an exemplary view including a terrain map and various indicators.

FIG. 3 depicts another example wherein selective brightness control techniques may be utilized to enhance readability. Typically, a terrain map 300 and navigation indicators (e.g., indicators 302, 304, 306 and the like) are presented together on a display along with additional information such flight path, heading indicator, as well as other types of indicators. Reading difficulties may occur when certain indictors and the terrain map overlap against one another, and as a result, some indicators (e.g., indicator 306) may appear against a background that may be difficult to visually distinguish. It is noted that various techniques have been developed in efforts to enhance readability in such cases, including that described in: Graphical Methods for Enhancing Attitude Awareness, U.S. Pat. No. 7,724,155, which is herein incorporated by reference in its entirety. For instance, techniques such as drop shadows, provide halos around alphanumerics, apply contrasting colors and the like may be utilized to visually distinguish the various indicators.

It is contemplated that visual distinctions may also be provided by adjusting brightness levels in addition to (or alternative to) the aforementioned techniques. For example, the text associated with the indicator 306 may be displayed at a certain brightness level that is different from the brightness level of the terrain map 300, effectively making the text associated with the indicator 306 more readable. It is to be understood that that the example depicted in FIG. 3 is merely exemplary. The techniques of using brightness levels to enhance readability may be applied to various other situations without departing from the broad scope of the inventive concepts disclosed herein.

Figure 4:
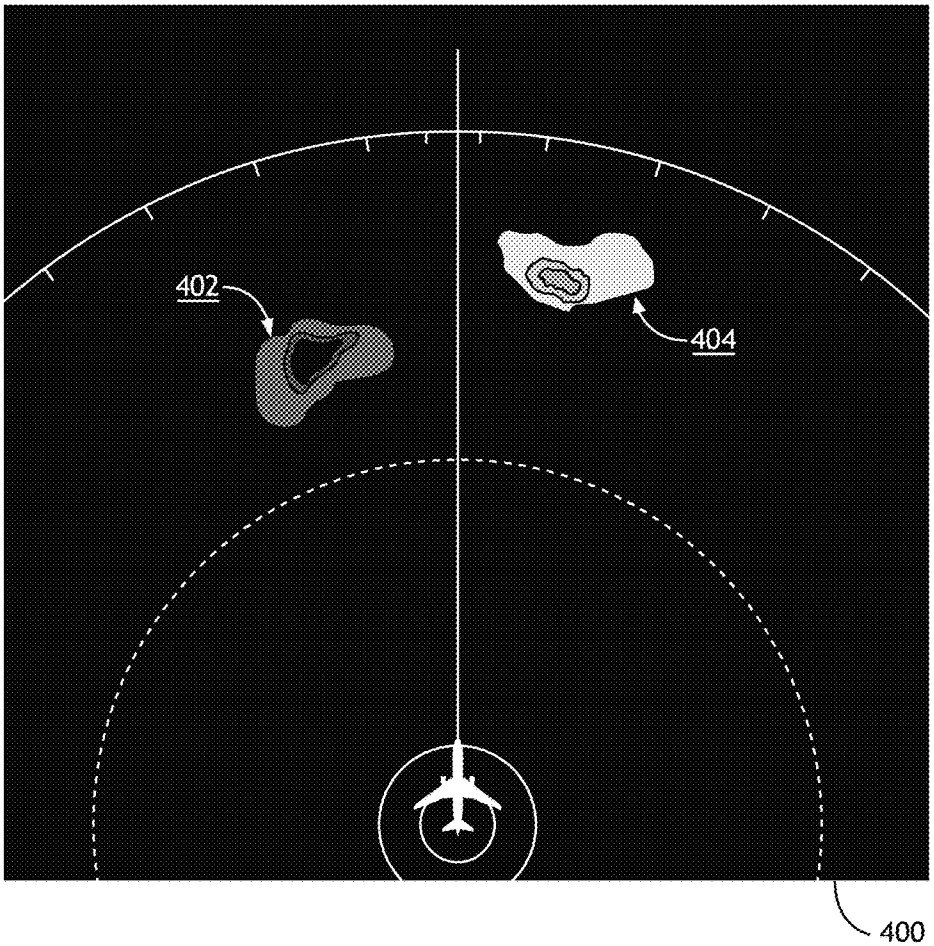
FIG. 4 is an illustration depicting an exemplary view including weather conditions.

FIG. 4 depicts still another example wherein selective brightness control techniques may be utilized to enhance readability. For illustrative purposes, suppose two weather patterns 402 and 404 are detected in the general direction of the flight and are displayed on a map 400. Also suppose that one of the weather patterns, 402, is determined to be at a much lower altitude and is not of a particular concern. Utilizing selective brightness control, the brightness level of the weather pattern 402 may be decreased to a certain level (e.g., 50% dimmed) with respect to the weather pattern 404 to deemphasize the operational significance of the weather pattern 402. Conversely, the brightness level of the weather pattern 404 may be increased to a certain level (e.g., 50% brighter) with respect to the weather pattern 402 to emphasize the operational significance of the weather pattern 404.

It is contemplated that the abilities to utilize brightness levels to emphasize or deemphasize significances of certain conditions is not limited to weather patterns. Embodiments of the inventive concepts disclosed herein may be applicable to various other types of conditions, such as traffic conditions, flight restrictions, as well as other types of conditions without departing from the broad scope of the inventive concepts disclosed herein.

Furthermore, it is contemplated that embodiments of the inventive concepts disclosed herein are not limited to static images. That is, the selective brightness control techniques in accordance with the inventive concepts disclosed herein are applicable to videos, synthetic visions, as well as other types of graphical representations without departing from the broad scope of the inventive concepts disclosed herein.

Figure 5:
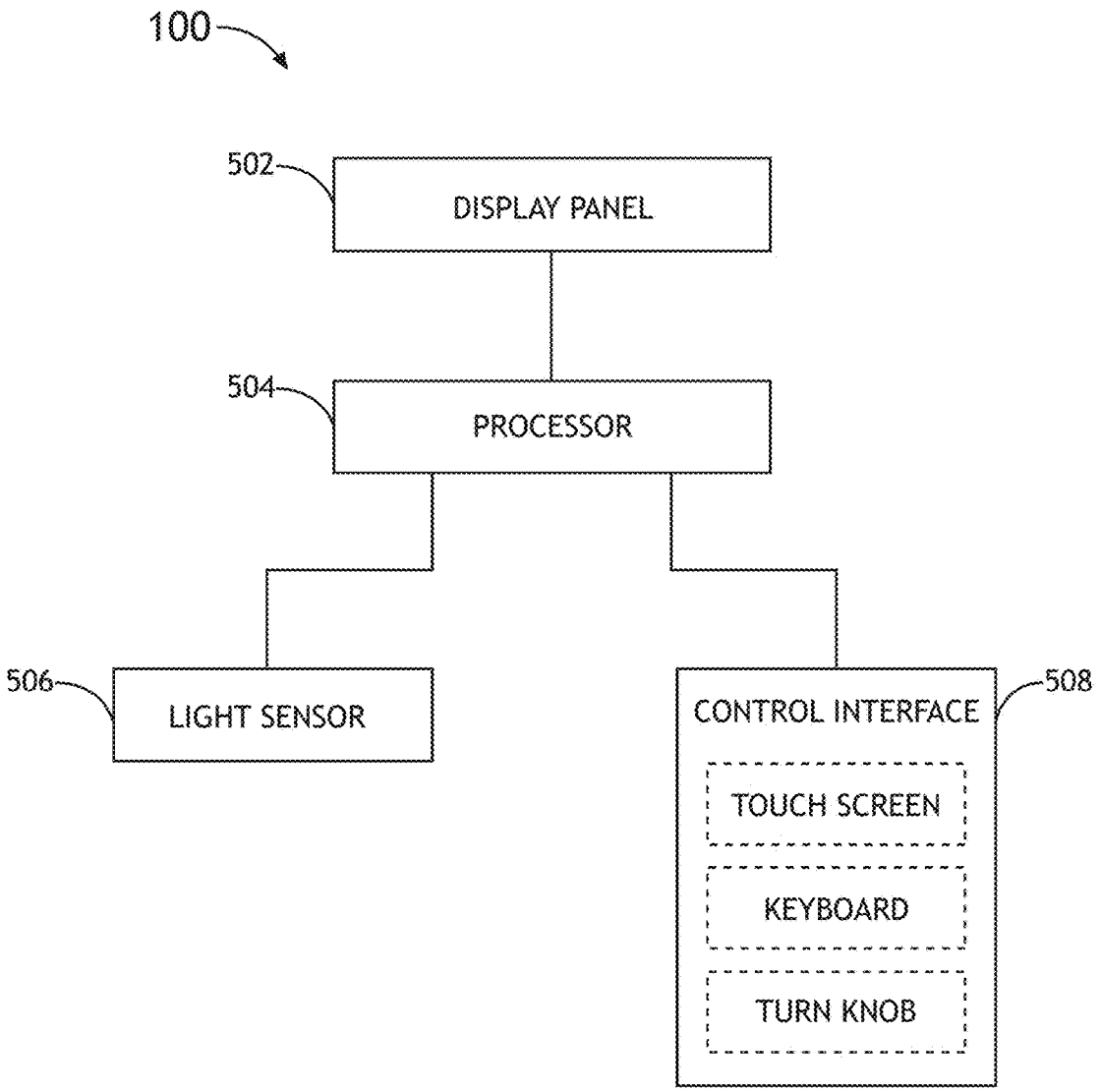
FIG. 5 is a block diagram depicting an embodiment of a display system.

Referring now to FIG. 5, a block diagram depicting an embodiment of a display system 500 is shown. It is contemplated that the display system 500 may be positioned onboard a vehicle (e.g., utilized as an aircraft cockpit display). Alternatively and/or additionally, the display system 500 may be utilized as a head up display, a handheld display, a wall mounted display, a desktop display, a head mounted display, or various other types of displays.

The display system 500 includes a display panel 502, which is configured to support independently controllable brightness levels for a plurality of pixels or pixel groups within the same display panel 502. In some embodiments, the brightness level of each pixel within the display panel 502 is independently controllable. In some embodiments, the pixels within the display panel 502 form multiple groups, and the brightness level of each group of pixels within the display panel 502 is independently controllable. It is contemplated that the granularity of control may vary based on specific hardware configuration of the display panel 502. In some embodiments, the display panel 502 includes an OLED display; it is to be understood, however, that other display technologies capable of supporting independently controllable brightness levels may also be utilized without departing from the broad scope of the inventive concepts disclosed herein.

In some embodiments, one or more light sensors 506 may be utilized to sense ambient light conditions and provide the information to a processor 504. It is to be understood that the processor 504 may be implemented as a dedicated processing unit, an application-specific integrated circuit (ASIC), an integrated component of an existing hardware or firmware configured to control operations of the display panel 502, or various other types of processing units without departing from the broad scope of the inventive concepts disclosed herein. The processor 504 also may receive control input provided by one or more users through a control interface 508. As previously described, the control interface 508 may include a touch screen interface, a keyboard interface, a turn knob interface, as well as various other types of input devices without departing from the broad scope of the inventive concepts disclosed herein.

As previously described, ambient light conditions received from the light sensor(s) 506 and user preferences received from the control interface 508 may be utilized by the processor 504 to control the brightness level of the display panel 502. In addition, the processor 504 may be configured to support one or more selective brightness control techniques described above. More specifically, the processor 504 may use the ambient light conditions and user preferences for control of the overall display brightness, and use context information from the currently displayed content to determine an additional level of brightness adjustment (e.g., increasing or decreasing from the overall level) for specific pixels or groups of pixels of the display panel 502. As illustrated in the various examples described above, the specific pixels or pixel groups where brightness level(s) may be adjusted may include application windows, user-defined display areas, as well as graphical user interface (GUI) elements, including text messages, alphanumerics, dialog boxes, symbols, and various other types of indicators. The processor 504 may also use selective brightness control to effectively enhance certain graphical effects such as haloing and transparencies.

Figure 6:
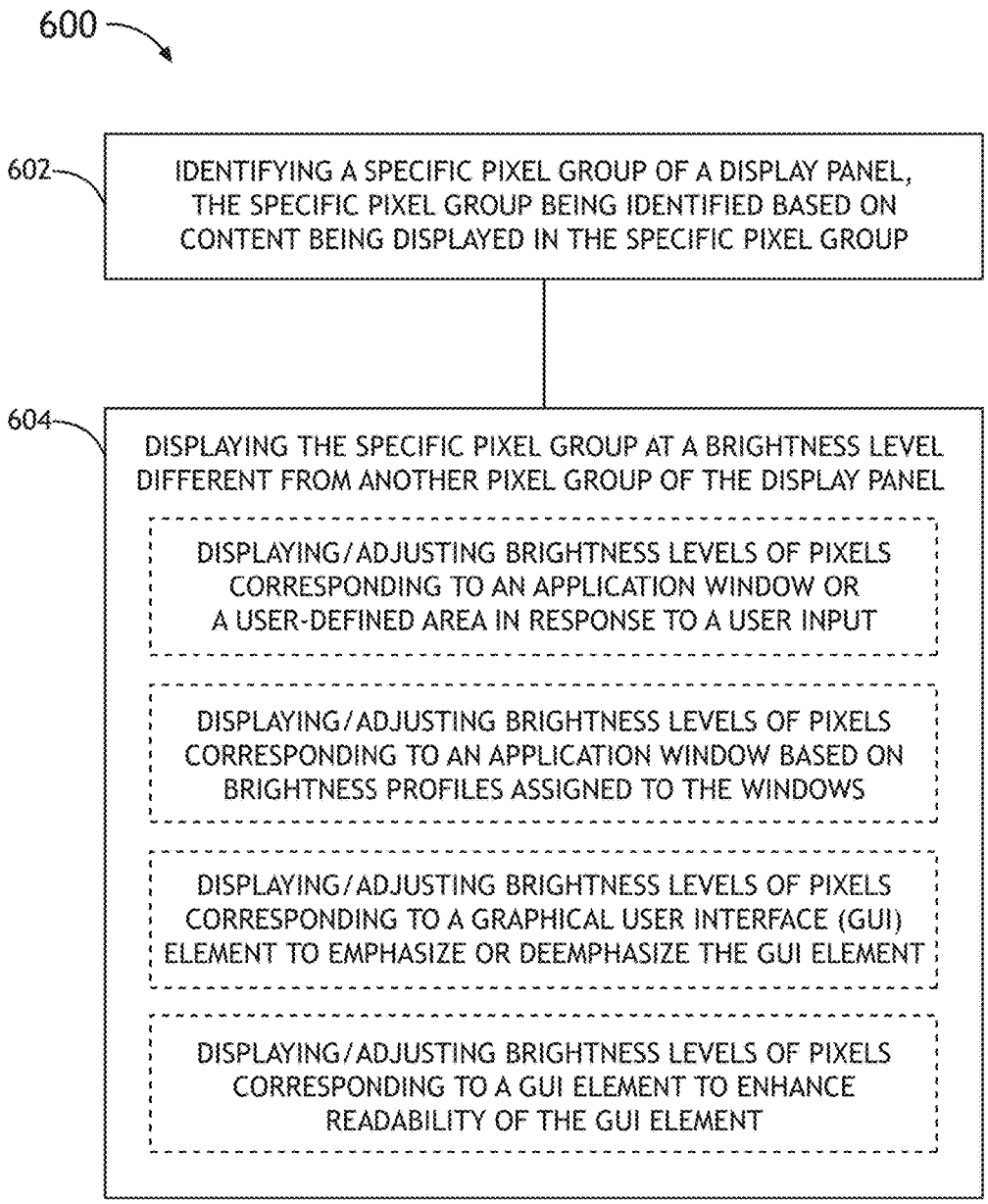
FIG. 6 is a flow diagram depicting an embodiment of a method for providing localized brightness control for a display panel.

Referring now to FIG. 6, a flow diagram depicting an embodiment of a method 600 for providing localized brightness control for a display panel is shown. Specific pixels or pixel groups of the display panel may be identified in a step 602 for localized brightness control. As previously described, the pixels or pixel groups identified for localized brightness control may correspond to a user-interface window managed by an application, a user-defined area within the display panel, a GUI element such as a text message, a dialog box, a symbol, an indicator or the like. The pixels or pixel groups identified for localized brightness control may then be displayed in a step 604 at a brightness level that is different from other parts of the display panel. For example, pixels corresponding to an application window or a user-defined area that may appear to be too bright (or too dark) may be adjusted manually (e.g., in response to a user input) or automatically (e.g., based on brightness profiles assigned to the windows) as previously described. In another example, pixels corresponding to certain graphical element(s) may be displayed at a brightness level different from other parts of the display panel to emphasize or deemphasize the graphical element(s). In still another example, pixels corresponding to certain graphical element(s) may be displayed at the brightness level visually distinct from adjacent pixels of the display panel to enhance readability. It is contemplated that additional localized brightness control techniques may also be implemented without departing from the broad scope of the inventive concepts disclosed herein.

It is to be understood that the present disclosure may be conveniently implemented in forms of a software, hardware or firmware package. Such a package may be a computer program product which employs a computer-readable storage medium including stored computer code which is used to program a computer to perform the disclosed function and process of the present invention. The computer-readable medium may include, but is not limited to, any type of conventional floppy disk, optical disk, CD-ROM, magnetic disk, hard disk drive, magneto-optical disk, ROM, RAM, EPROM, EEPROM, magnetic or optical card, or any other suitable media for storing electronic instructions.

It is to be understood that embodiments of the inventive concepts described in the present disclosure are not limited to any underlying implementing technology. Embodiments of the inventive concepts of the present disclosure may be implemented utilizing any combination of software and hardware technology and by using a variety of technologies without departing from the broad scope of the inventive concepts or without sacrificing all of their material advantages.

It is to be understood that the specific order or hierarchy of steps in the processes disclosed is an example of exemplary approaches. It is to be understood that the specific order or hierarchy of steps in the processes may be rearranged while remaining within the broad scope of the present disclosure. The accompanying method claims present elements of the various steps in a sample order, and are not meant to be limited to the specific order or hierarchy presented.

It is believed that the inventive concepts disclosed herein and many of their attendant advantages will be understood by the foregoing description, and it will be apparent that various changes may be made in the form, construction, and arrangement of the components thereof without departing from the broad scope of the inventive concepts or without sacrificing all of their material advantages. The form herein before described being merely an explanatory embodiment thereof, it is the intention of the following claims to encompass and include such changes.

What is claimed is:

1. A system, comprising:

a display panel configured to support independently controllable brightness levels for a plurality of pixel groups within the display panel; and a processor in communication with the display panel, the processor configured to identify a specific pixel group of the display panel based on content being displayed in the specific pixel group, and the processor further configured to set a brightness level of the specific pixel group differently from a first other pixel group and a second other pixel group of the display panel, the first other pixel group and the second other pixel group having different brightness levels, wherein each of the specific pixel group, the first other pixel group, and the second other pixel group is associated with a brightness profile, each brightness profile indicating one of at least three brightness levels, and wherein the brightness level of the specific pixel group is determined at least partially based on a comparison of the brightness profile associated with the specific pixel group with at least one brightness profile associated with at least one of the first other pixel group and the second other pixel group.

2. The system of claim 1, wherein the specific pixel group is identified when the content being displayed in the specific pixel group comprises an alert.

3. The system of claim 1, wherein the specific pixel group is identified when the content being displayed in the specific pixel group comprises an indicator that overlaps against a background.

4. The system of claim 1, wherein the specific pixel group is identified when the content being displayed in the specific pixel group comprises a graphical user interface (GUI) element having a particular level of concern.

5. The system of claim 4, wherein the GUI element includes at least one of: a text message, a dialog box, a symbol, and an indicator.

6. The system of claim 4, wherein the brightness level of the specific pixel group is determined at least partially based on the particular level of concern of the GUI element and is different from another pixel group of the display panel to emphasize or deemphasize the GUI element.

7. The system of claim 1, wherein the brightness level of the specific pixel group is set to be visually distinct from adjacent pixels of the display panel to enhance readability of the specific pixel group.

8. The system of claim 1, wherein the display panel is positioned on a vehicle.

9. The system of claim 8, wherein the display panel is an aircraft cockpit display.

10. A system, comprising:

a display panel configured to support independently controllable brightness levels for a plurality of pixel groups within the display panel;

an ambient light sensor; and a processor in communication with the display panel and the ambient light sensor, the processor configured to adjust an overall brightness level of the display panel at least partially based on input received from the ambient light sensor, the processor further configured to adjust a local brightness level of a specific pixel group of the display panel based on content being displayed in the specific pixel group, wherein the local brightness level of the specific pixel group is different from a first other pixel group and a second other pixel group of the display panel, the first other pixel group and the second other pixel group having different local brightness levels, wherein each of specific pixel group, the first other pixel group, and the second other pixel group is associated with a brightness profile, each brightness profile indicating one of at least three local brightness levels, and wherein the local brightness level of the specific pixel group is determined at least partially based on a comparison of the brightness profile associated with the specific pixel group with at least one brightness profile associated with at least one of the first other pixel group and the second other pixel group.

11. The system of claim 10, wherein the specific pixel group corresponds to at least one of: a specific user-interface window managed by an application and a user-defined area within a viewable area of the display panel.

12. The system of claim 10, wherein the specific pixel group corresponds to a graphical user interface (GUI) element.

13. The system of claim 10, wherein the brightness level of the specific pixel group is adjusted to emphasize or deemphasize the specific pixel group.

14. The system of claim 10, wherein the brightness level of the specific pixel group is adjusted to be visually distinct the specific pixel group from adjacent pixels of the display panel to enhance readability of the specific pixel group.

15. A method, comprising:

identifying a specific pixel group of a display panel, the specific pixel group being identified based on content being displayed in the specific pixel group; and displaying the specific pixel group at a brightness level different from a first other pixel group and a second other pixel group of the display panel, the first other pixel group and the second other pixel group having different brightness levels, wherein each of the specific pixel group, the first other pixel group, and the second other pixel group is associated with a brightness profile, each brightness profile indicating one of at least three brightness levels, and wherein the brightness level of the specific pixel group is determined at least partially based on a comparison of the brightness profile associated with the specific pixel group with at least one brightness profile associated with at least one of the first other pixel group and the second other pixel group.

16. The method of claim 15, wherein the specific pixel group corresponds to a specific user-interface window managed by an application.

17. The method of claim 15, wherein the specific pixel group corresponds to a user-defined area within a viewable area of the display panel.

18. The method of claim 15, wherein the specific pixel group corresponds to a graphical user interface (GUI) element.

19. The method of claim 15, wherein the specific pixel group is displayed at the brightness level different from another pixel group of the display panel to emphasize or deemphasize the specific pixel group.

20. The method of claim 15, wherein the specific pixel group is displayed at the brightness level visually distinct from adjacent pixels of the display panel to enhance readability of the specific pixel group.

* * * * *